US006176747B1

(12) United States Patent
Rowe et al.

(10) Patent No.: US 6,176,747 B1
(45) Date of Patent: Jan. 23, 2001

(54) TERMINAL BLOCK WITH FRONT TO MULTIPLE REAR FAST-ON TERMINATIONS

(75) Inventors: Neal Edward Rowe, Asheville, NC (US); Robert Lewis Newton, Jr., Elgin, IL (US)

(73) Assignees: Eaton Corporation, Cleveland, OH (US); Cooper Technologies Company, Houston, TX (US)

( * ) Notice: Under 35 U.S.C. 154(b), the term of this patent shall be extended for 0 days.

(21) Appl. No.: 09/204,958

(22) Filed: Dec. 3, 1998

(51) Int. Cl.[7] ..... H01R 9/22
(52) U.S. Cl. ..... 439/721; 439/701
(58) Field of Search ..... 439/721, 722, 439/723, 724, 711, 712, 715, 718, 755, 709, 733.1

(56) References Cited

U.S. PATENT DOCUMENTS 4,174,147 * 11/1979 Waddington et al. ..... 339/176 MP
4,449,778 * 5/1984 Lane ..... 339/143 R
5,563,372 * 10/1996 Messelhi ..... 174/60
5,595,505 * 1/1997 Duke et al. ..... 439/630
5,984,735 * 11/1999 Daoud ..... 439/733.1

* cited by examiner

*Primary Examiner*—Brian Sircus
*Assistant Examiner*—Chandrika Prasad
(74) *Attorney, Agent, or Firm*—Martin J. Moran

(57) ABSTRACT

A terminal block has a molded electrically insulative housing with through compartments containing terminal members each having a rectangular planar front section with a tapped hole for a terminal screw and three male terminal blades extending rearward from edges of the rectangular planar front section. The rectangular front section seats on ledges formed by bands integrally molded on opposing side walls of the compartments. Barbs projecting laterally from two facing male terminal blades engage the molded bands to secure the terminal member in the compartment. Partitions extending transversely between the front openings of the compartments provide electrical isolation between the screw terminals, and extend laterally beyond the molded body of the housing at both ends of the partitions to form mounting shoulders, which together with shoulders on projections molded on the housing body, secure the terminal block in an opening in a mounting panel. A cover integrally connected by a living hinge to a wall extending along one end of the partitions controls access to the screw connections on the planar front section of the terminal members.

16 Claims, 4 Drawing Sheets

67
63
65
81
85
87
35
61
75
63
65
67
1
3
9
39
5

39
51
49
43
31
57
55
33
37
41
53
47
59
45
35

FIG. 4
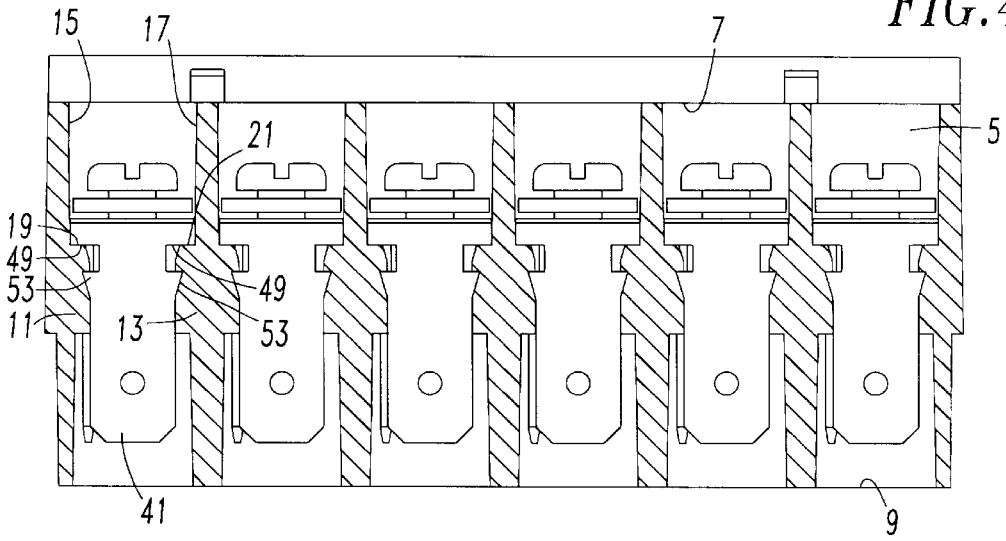
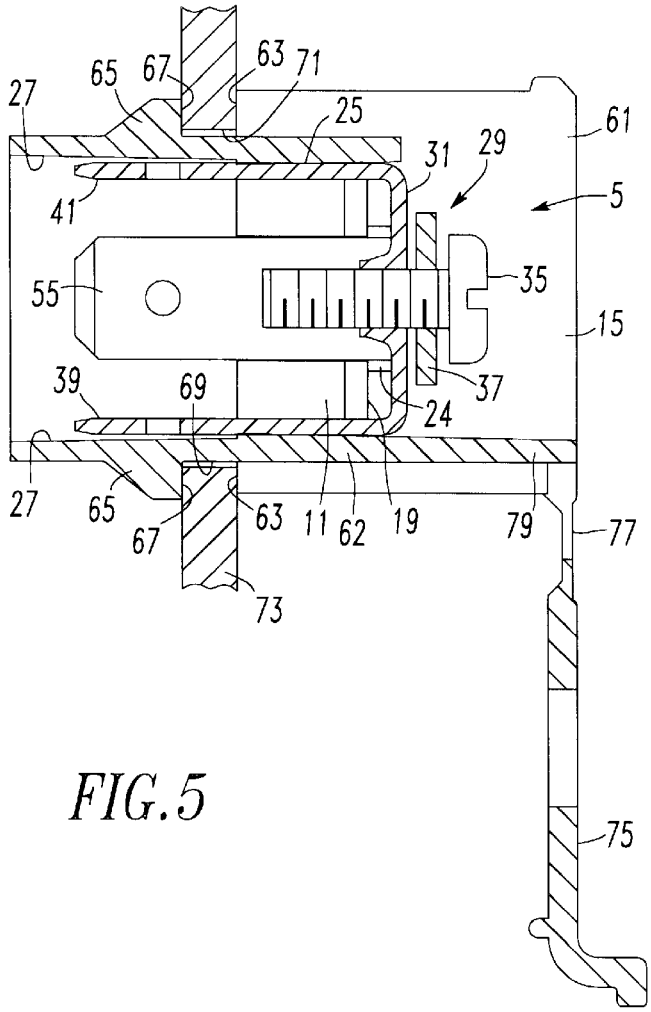
FIG. 5

TERMINAL BLOCK WITH FRONT TO MULTIPLE REAR FAST-ON TERMINATIONS

BACKGROUND OF THE INVENTION

1. Field of the Invention

This invention relates to terminals blocks, and more particularly, terminal blocks with multiple male terminal blades for engagement by multiple female fast-on terminal connectors.

2. Background Information

A common type of terminal connector for connecting electrical wiring is the fast-on connector in which a female connector slides on and clamps a male terminal blade. In one arrangement, a male terminal blade is formed integrally with a screw connection provided by a transverse tab with a threaded aperture. A molded terminal block has a plurality of side-by-side recesses in each of which the tab of a terminal is seated with the male terminal blade projecting through a slot extending toward the rear. The male terminal blade extends through and beyond a tubular extension molded on the rear of the terminal block. The male terminal blade is centrally aligned with a tab by an offset which has barbs for securing the terminal in the molded block. A flange on the tab opposite the offset also has retaining barbs.

The female fast-on connector is provided on the lead to be terminated. Selective connection to this lead can then be made by securing another lead to the screw connection. In some applications, there is a need to terminate more than one lead with a common termination. One such application is the termination for secondary wiring in switchgear assemblies for electric power distribution systems.

There is a need, therefore, for an improved terminal block which accommodates the termination of multiple leads with a common terminal point. There is a more particular need for such an improved terminal block which provides for multiple terminations using fast-on connectors for the terminated leads.

SUMMARY OF THE INVENTION

These needs and others are satisfied by the invention which is directed to a terminal block which comprises a molded electrically insulative housing having at least one, and typically a plurality, of compartments having a front opening and a rear opening, electrically conductive terminal members are provided in the compartments. These terminal members comprise a planar front section and at least a pair, and preferably three, integral male terminal blades extending rearward from edges of the planar front section. The planar front section has a threaded aperture which receives a terminal screw. The terminal member is secured in the compartment with the planar front section extending transversely across the compartment and accessible from the front opening and with the male terminal blades extending toward, and accessible from, the rear opening.

Preferably, the compartments in the molded housing are rectangular in cross-section and extend through the housing from the front opening to the rear opening. The planar front sections are rectangular and sized to extend across the compartment with the male terminal blades extending from edges of the planar front section.

In the preferred terminal block where the terminal member has three male terminal blades, two facing male terminal blades extend from first and second parallel edges of the rectangular front section and a middle male terminal blade extends from a third edge between the first and second edges. The facing blades have integrally formed laterally extending barbs which engage the housing to retain the terminal member in the compartment. In the preferred form of the invention, opposing side walls of the compartments have ledges recessed from the front opening. The first and second parallel edges of the planar front section of the terminal member are wider than the facing male terminal blades thereby forming shoulders which seat on the ledges. Preferably, the ledges are formed by molded bands extending across opposing side walls within the compartments. One band has an axially extending slot through which the middle blade extends. Most preferably, the middle blade of the terminal member extends from a recess in the third edge of the planar front section and the axially extending slot in the one band has a depth less than the width of the ledge so that the middle leg is inwardly spaced from the walls of the compartment for easier engagement by a female fast-on connector. In another embodiment of the invention, the terminal member has another middle blade extending from a fourth edge of the planar front section substantially parallel to the first middle blade.

In one embodiment of the invention, the housing has a molded body in which the compartments are formed and includes partitions which extend transversely between the compartments adjacent the front openings. The terminal block can be adapted for mounting in a mounting opening in a mounting panel by extending the partitions laterally beyond the molded body to form aligned first mounting shoulders at both ends of the partitions. Projections molded on the body form second mounting shoulders spaced from the first mounting shoulders to form mounting slots in which the mounting panel is received to mount the terminal block in the mounting opening.

As another aspect of the invention, the terminal block can have a hinged cover over the screw connections. In this arrangement, an end wall is provided at one end of the partitions and the cover is connected to this end wall by an integrally molded living hinge. In the preferred arrangement, the cover can have apertures through which the screws are accessible even with the cover closed. In the preferred form of the terminal block, the male terminal blades are fully contained within the compartment in the housing but accessible through the rear opening.

BRIEF DESCRIPTION OF THE DRAWINGS

A full understanding of the invention can be gained from the following description of the preferred embodiments when read in conjunction with the accompanying drawings in which:

FIG. 4 is a longitudinal sectional view through a portion of the terminal block.

FIG. 5 is a cross-sectional view taken along the line 5—5 in FIG. 1.

DESCRIPTION OF THE PREFERRED EMBODIMENTS

Figure 1:
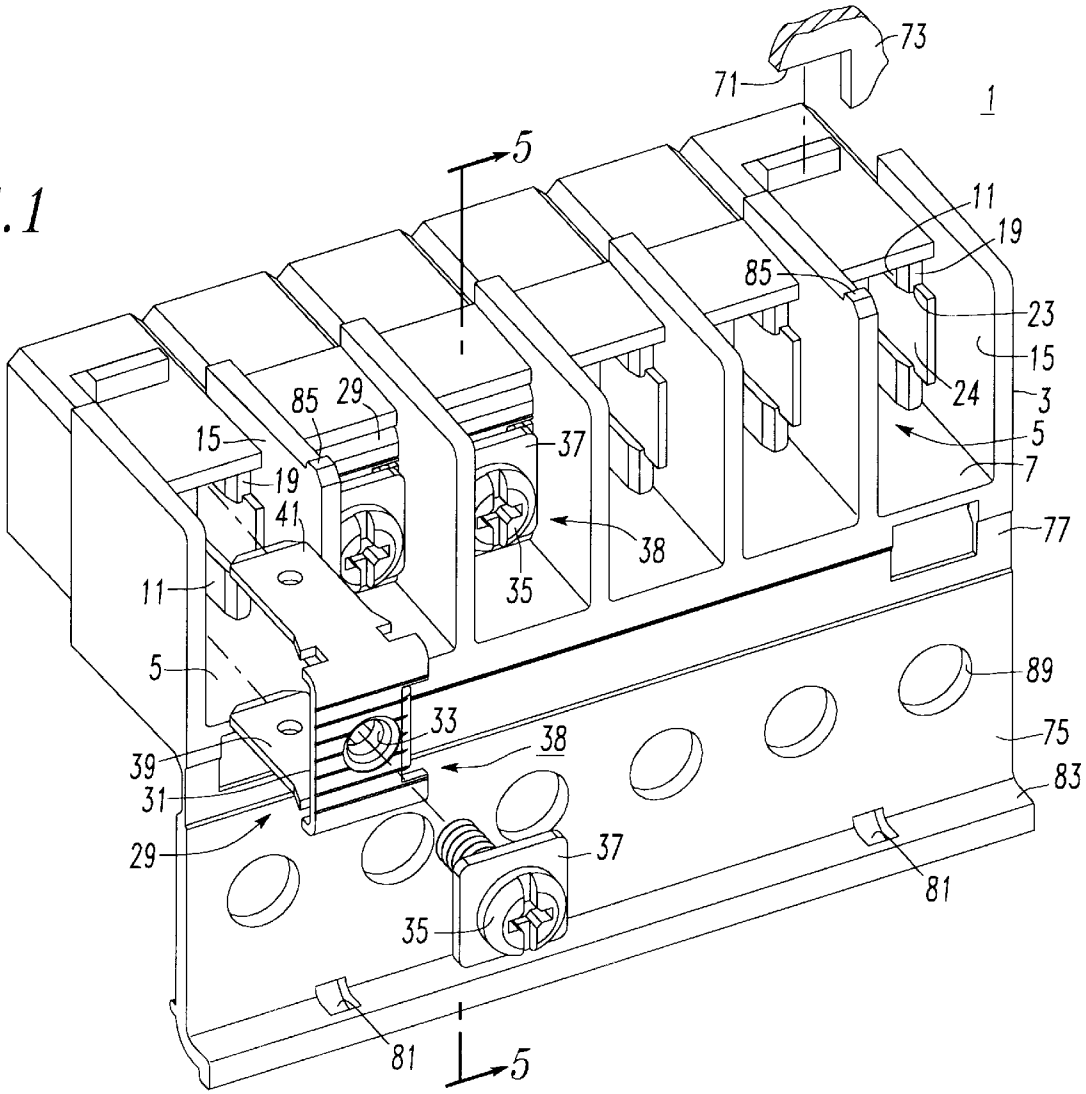
FIG. 1 is an isometric view of a terminal block in accordance with the invention shown with the cover open and one of the terminal members removed.
Figure 2:
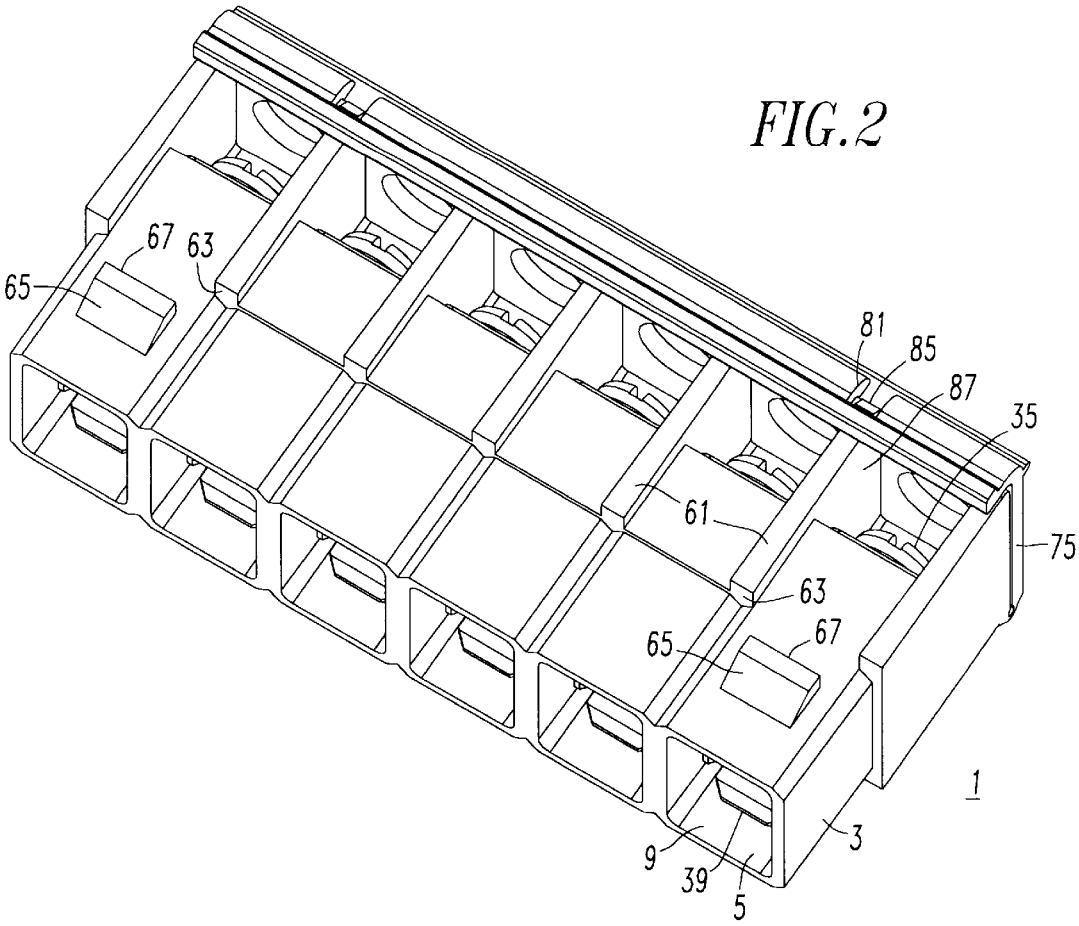
FIG. 2 is a rear isometric view of the terminal block of FIG. 1 with the cover closed.

Referring to FIGS. 1 and 2, the terminal block 1 of the invention includes a housing 3 molded from an electrically insulative resin. The housing has a plurality of compartments 5 which are rectangular in cross-section and extend through the housing 3 from a front opening 7 to a rear opening 9. Referring also to FIGS. 4 and 5, a pair of integrally molded bands 11 and 13 on opposing sidewalls 15 and 17 of the compartments 5 form ledges 19 and 21. A slot 23 extends longitudinally through the band 11. This slot 23 has a depth which is less than the width of the ledge 19. A raised area 24 extends forward on the side wall 15 beyond the ledge 19 and is co-extensive with the bottom of the groove 23, as best seen in FIG. 1. Narrow ledges 25 are integrally molded in the other sidewalls 27 in the compartment 5 at the same level as the rearward edge of the bands 11 and 13.

Figure 3:
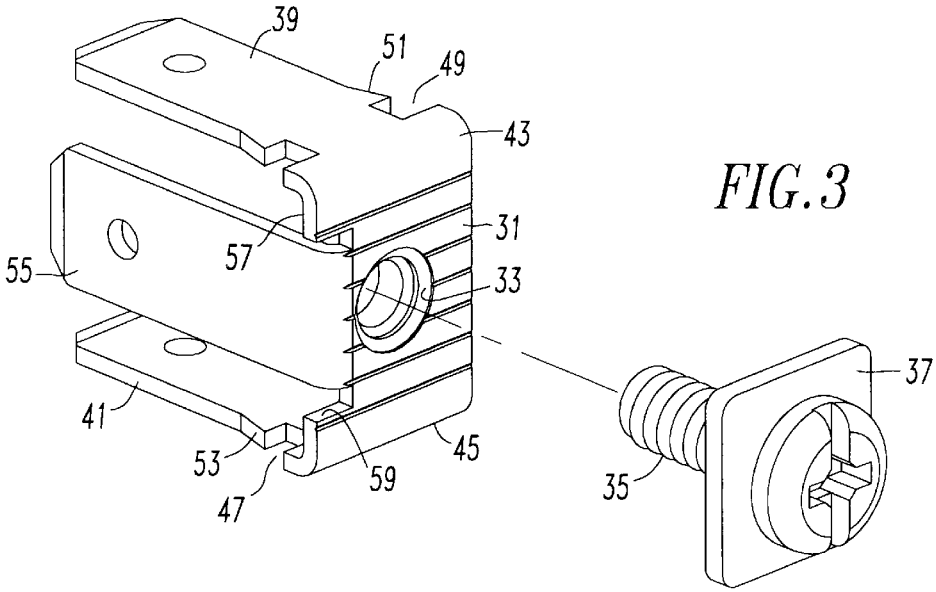
FIG. 3 is an exploded isometric view of a three-bladed terminal which forms part of the terminal block of FIGS. 1 and 2 shown together with a terminal screw and clamp.
Figure 6:
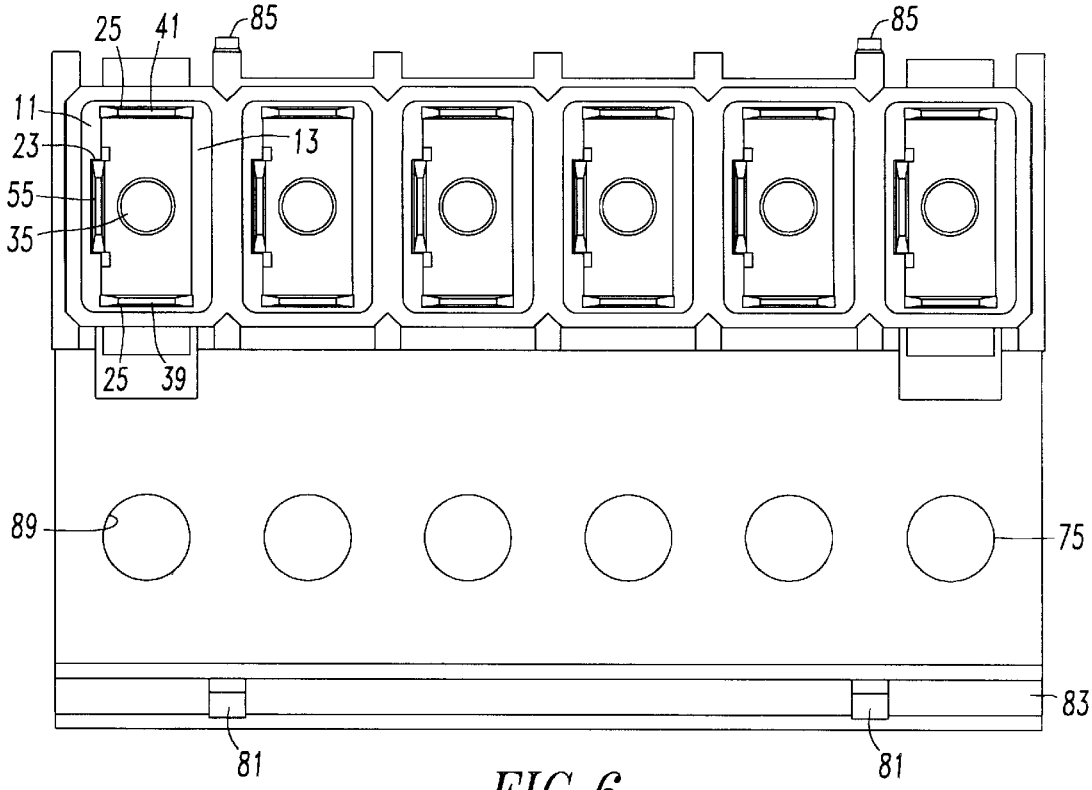
FIG. 6 is a rear elevation view of the terminal block with cover open.

Mounted in each of the compartments 5 of the terminal block 1 is a terminal member 29. As best seen in FIG. 3, each terminal member 29 which is fabricated from electrically conductive sheet material has a planar front section 31 with a centrally located tapped aperture 33. This planar front section 31 is rectangular and sized to pass through the front opening 7 in the compartment 5. A screw 35 with a captured clamp plate 37 engages the tapped aperture 33 to form with the terminal member 29 a screw termination 38.

Integrally formed with the planar front section 31 of the terminal member 29 are facing male terminal blades 39 and 41 which extend perpendicular to the planar front section 31 from first and second parallel edges 43 and 45 on the planar front section 31. These facing blades 39 and 41 do not extend the full width of the edges 43 and 45 thereby leaving shoulders 47 and 49. In addition, each of the blades 39 and 41 have barbs 51 and 53 formed adjacent the shoulders 47 and 49. A middle blade 55 extends downward from a third, intermediate edge 57 of the planar front section between the first and second edges 43 and 45. This middle blade 55 extends perpendicular to the planar front section 31 from a recess 59 in the intermediate edge 57. As can be seen, the flat middle blade 55 is perpendicular to the flat facing blades 39 and 41.

The terminal member 29 is inserted into a compartment 5 in the housing 3 until the shoulders 47 and 49 seat on the ledges 19 and 21 (as best seen in FIG. 4). The middle blade 55 extends through the slot 23 in the molded band 11. As the depth of the slot 23 is less than the width of the ledge 19, the middle blade 55 is spaced from the walls of the compartment adjacent the rear opening 9 as shown in FIG. 5. Similarly, the ledges 25 space the facing blades 39 and 41 from the walls of the compartment 5. This is important because the blades 39, 41 and 55 form the male elements of fast-on connectors which include a female connector (not shown) which slides onto and engages the male element.

With the terminal member 29 seated against the ledges 19 and 21, the barbs 51 and 53 dig into the molded bands 11 and 13 to retain the terminal member seated against the ledges 19 and 21 as best seen in FIG. 4.

The molded housing 3 also includes integral partitions 61 extending transversely between the compartments 5. These molded partitions extend laterally beyond the molded body 62 of the housing at each end to form first mounting shoulders 63. Also integrally formed with the molded housing are projections 65 which form second mounting shoulders 67 spaced from the mounting shoulders 63 formed by the partitions. The first and second mounting shoulders 63 and 67 form mounting grooves 69 which are engaged by the edges of a mounting opening 71 in a mounting plate 73.

Preferably, the terminal block 1 is provided with an integral cover 75.

This cover is connected to the housing 3 by a living hinge 77 integrally formed with an end wall 79 extending along one end of the partitions 61. A pair of notches 81 in a lip 83 extending along the free end of the cover 75 engage latch tabs 85 on aligned partitions to secure the cover in the closed position. As a longitudinal wall extension 79 is only provided along one end of the partitions 61, openings 87 are provided for electrical leads (not shown) connected to the terminal screws 35 even with the cover 75 in the closed position as seen in FIG. 2. Openings 89 in the cover 75 aligned with the terminal screws 35, allow insertion of test probes with the cover closed.

With the terminal block 1 of the invention, up to three leads can be terminated to a common point through fast-on female connectors (not shown) engaging the male blade elements 39, 41 and 55. A connection to this common termination point can be made through the terminal screw 35. With the terminal block 1 mounted in a mounting opening 71 in the mounting plate 73, the leads to be commonly terminated are separated from the termination lead.

Figure 7:
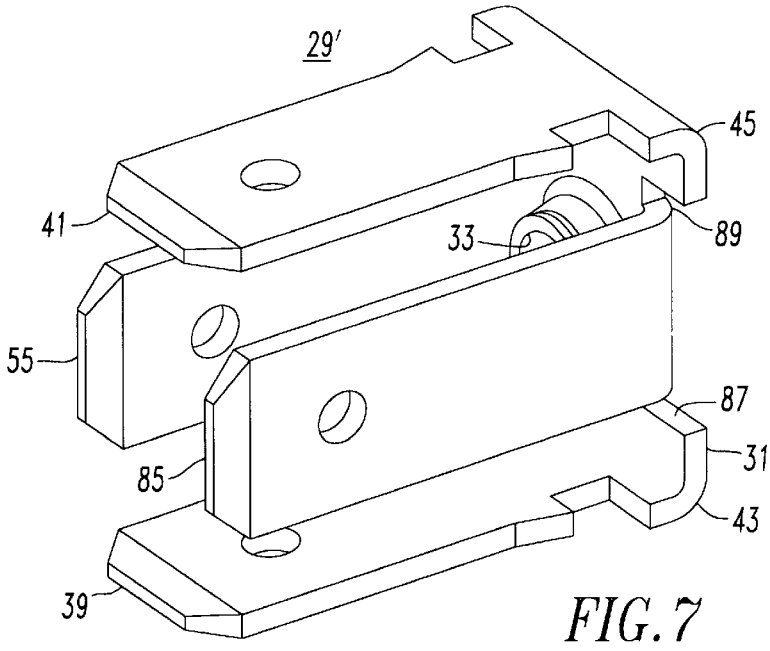
FIG. 7 is an isometric view of a four-bladed terminal in accordance with another embodiment of the invention.

In some applications, there may be a need for a terminal member with an additional male fast-on termination making a total of four such connections. Such a terminal member 29' is shown in FIG. 7. The fourth blade is an additional middle blade 85 extending downward from a recess 87 in a fourth, middle edge 89 of the planar front section 31 between the end edges 43 and 45. This fourth blade 85 is spaced from and substantially parallel to the other middle blade 55.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A terminal block comprising:

a molded electrically insulative housing having at least one compartment with a front opening and a rear opening; and at least one electrically conductive terminal member comprising a planar front section and at least two integral blades extending rearward from edges of said planar front section forming male terminals, said planar front section having a threaded aperture, and a terminal screw engaging the threaded aperture, said at least one terminal member being secured in said at least one compartment in said housing with said planar section facing and accessible through said front opening and said at least two blades extending toward and accessible through said rear opening.

2. The terminal block of claim 1 wherein said housing has a plurality of side-by-side compartments and an electrically conductive terminal member in each of said plurality of compartments.

3. The terminal block of claim 2 wherein said compartments are rectangular in cross-section and extend through said housing from said front opening to said rear opening, said planar front sections of said terminal members are rectangular and sized to extend across said compartment with said blades extending toward said rear opening from edges of said planar front section.

4. The terminal block of claim 3 wherein said electrically conductive terminal members have three blades including two facing blades extending from first and second parallel edges of said rectangular planar front section, and a middle blade extending from a third, intermediate edge of said planar front section between said first and second edges.

5. The terminal block of claim 4 wherein two opposing side walls of said compartments have ledges recessed from said front opening and said first and second edges of said planar front section are wider than said facing blades to form shoulders which seat on said ledges.

6. The terminal block of claim 5 wherein said ledges in said compartments are formed by molded bands extending across said opposing side walls, one of said molded bands having an axially extending slot through which said middle blade extends.

7. The terminal block of claim 6 wherein said middle blade extends from a recess in said third edge of said planar front section of said terminal member and said axially extending slot in said one molded band has a depth less than a width of the ledge of said one molded band.

8. The terminal block of claim 6 wherein said facing blades have laterally extending barbs which engage said bands to resist unseating of said planar front section from said ledges.

9. The terminal block of claim 4 wherein said three blades are fully contained within said compartments.

10. The terminal block of claim 4 wherein such electrically conductive terminal members have four blades including an additional middle blade extending from a fourth, intermediate edge of said planar front section between said first and second edges and generally parallel to said third blade.

11. The terminal block of claim 10 wherein said four blades are fully contained within said compartments.

12. The terminal block of claim 4 wherein said facing blades have laterally extending barbs which engage said housing to retain said terminal members in said compartments.

13. The terminal block of claim 2 wherein said compartments are formed in a molded body of said housing, and said molded housing has integral partitions projecting outward from the molded body between said compartments adjacent said front openings.

14. The terminal block of claim 13 adapted for mounting in a mounting opening in a mounting panel wherein said partitions extend laterally beyond said molded body to form aligned first mounting shoulders at both ends of said partitions, said housing further having projections on said molded body forming second mounting shoulders spaced from both of said first mounting shoulders to form mounting slots in which said mounting panel is received to mount said terminal block in said mounting opening.

15. The terminal block of claim 13 wherein said molded housing further has an end wall extending between one end of said partitions, and a cover integrally connected to said end wall by a living hinge and rotatable about said living hinge to cover and uncover said front openings of said compartments.

16. The terminal block of claim 15 wherein said cover has apertures aligned with said terminal screws.

* * * * *